US005875887A

United States Patent [19]

Tsai

[11] Patent Number: 5,875,887

[45] Date of Patent: Mar. 2, 1999

[54] CONTACT SWITCH ASSEMBLY HAVING A CONDUCTOR THAT HOLDS A MOVABLE CONTACT PLATE

[75] Inventor: Chin-Shan Tsai, Taipei Hsien, Taiwan

[73] Assignee: Shin Jiuh Corp., Taipei Hsien, Taiwan

[21] Appl. No.: 856,596

[22] Filed: May 15, 1997

[51] Int. Cl.[6] ..... H01H 13/26

[52] U.S. Cl. ..... 200/461

[58] Field of Search ..... 200/408, 409, 200/459, 461, 454, 467, 6 C, 6 R

[56] References Cited

U.S. PATENT DOCUMENTS 5,017,747 5/1991 Nagahara et al. ..... 200/459 X
5,432,311 7/1995 Lin ..... 200/467

FOREIGN PATENT DOCUMENTS 922898 4/1982 U.S.S.R. ..... 200/461

*Primary Examiner*—Renee S. Luebke

*Attorney, Agent, or Firm*—Finnegan, Henderson, Farabow, Garrett & Dunner, L.L.P.

[57] ABSTRACT

A contact switch assembly includes a first conductor body which has a leg portion and a U-shaped mounting unit with upward first and second mounting arms and a connecting portion that interconnects the first and second mounting arms. The first and second mounting arms have transverse retaining grooves at opposing outer sides thereof. A movable contact arm includes an elongated contact plate which has a longitudinal opening and which is sleeved around the first and second mounting arms via the opening. The contact plate further has first and second inner edges at two longitudinally opposing ends of the opening. The first inner edge engages the retaining groove of the first mounting arm. A curved spring plate has a first end engaging the retaining groove of the second mounting arm, and a second end engaging the second inner edge so as to bias the second inner edge upward. The second end of the spring plate has a first portion for abutting against a bottom surface of the contact plate, and a second portion for abutting against a top surface of the contact plate, thereby preventing release of the second end from the second inner edge.

5 Claims, 4 Drawing Sheets

CONTACT SWITCH ASSEMBLY HAVING A CONDUCTOR THAT HOLDS A MOVABLE CONTACT PLATE

BACKGROUND OF THE INVENTION

1. Field of the Invention

This invention relates to a contact switch assembly, more particularly to a contact switch assembly having stationary conductors, one of which holds a spring-loaded contact plate to selectively contact the other conductors.

2. Description of the Related Art

Referring to FIG. 1, a conventional contact switch, such as a microswitch, is shown to comprise a casing 11, a common conducting unit including a conductor body 12 and an elongated movable contact plate 13 mounted on the conductor body 12, a button member 14, and first and second conductors 15, 16. Each of the conductor body 12 and the first and second conductors 15, 16 has a leg portion that extends out of the casing 11. The button member 14 is disposed in the casing 11 on top of the contact plate 13, and is operable so as to move the contact plate 13 from a first position, where the contact plate 13 connects the conductor body 12 and the first conductor 15, and a second position, where the contact plate 13 connects the conductor body 12 and the second conductor 16.

The conductor body 12 has a horizontal plate portion 121, a leg portion 122 extending integrally and downwardly from one end of the plate portion 121, and first and second mounting arms 123, 124 extending upwardly from two ends of the plate portion 121. The first and second mounting arms 123, 124 are formed with horizontal retaining grooves 1230, 1240. The retaining groove 1230 is disposed higher than the retaining groove 1240.

The contact plate 13 has an integral spring extension 132 formed within a longitudinal opening via a punching process, and a contact stub 131.

When the contact plate 13 is mounted on the conductor body 12, the first and second mounting arms 123, 124 extend through the longitudinal opening of the contact plate 13 and the retaining grooves 1230, 1240 engage one of the punched edges and the spring extension 132 respectively. At this time, the spring extension 132 is bent so as to bias the contact stub 131 to the first position.

During assembly, the first and second conductors 15, 16 are first secured to the casing 11. Due to space restrictions, the common conducting unit is assembled before being secured to the casing 11. Finally, the button member 14 is mounted to the casing 11 to complete assembly of the contact switch.

The drawback of the conventional conducting unit is as follows: The contact plate 13 is moved via the biasing force of the spring extension 132. The spring extension 132 is subject to breaking after long-term use.

To solve the above problem, referring to FIGS. 2 and 3, another conventional contact plate 23 is shown to include a main plate 231 and a separate spring plate 232 which is curved upward. The spring plate 232 has two horizontal ends 2321, 2322. When mounted on the conductor body 22, the spring plate 232 is moved upward relative to the main plate 231. The end 2321 of the spring plate 232 engages the second retaining groove 224 while the end 2322 abuts against a bottom surface of the main plate 231 immediately below an edge of the contact plate 23. However, there are still some drawbacks as follows: During assembly, the main and spring plates 231, 232 are first mounted on the conductor body 22 and are then mounted in the casing (not shown) of the contact switch. Since the spring plate 232 only abuts against the bottom surface of the main plate 231, it tends to be released downwardly from the latter although upward release movement can be prevented. After mounting the first and second conductors (not shown) and the conductor body 22 in the casing, the main and spring plates 231, 232 are mounted on the conductor body 22 from the top of the casing. Since the spring plate 232 is small, it is difficult to press and bend the small spring plate 232 to fit the same in the opening of the main plate 231 to engage the same with the conductor body 22.

SUMMARY OF THE INVENTION

The main object of the present invention is to provide a contact switch assembly with a conducting unit which can be assembled outside the casing of the contact switch assembly before being loaded in the casing.

Another object of the present invention is to provide a conducting unit which has a spring plate firmly secured to a main plate.

According to this invention, a contact switch assembly includes a first conductor body which has a leg portion and a U-shaped mounting unit with upward first and second mounting arms and a connecting portion that interconnects the first and second mounting arms. The first and second mounting arms have transverse retaining grooves at opposing outer sides thereof. A movable contact arm includes an elongated contact plate which has a longitudinal opening and which is sleeved around the first and second mounting arms via the opening. The contact plate further has first and second inner edges at two longitudinally opposing ends of the opening. The first inner edge engages the retaining groove of the first mounting arm. A curved spring plate has a first end engaging the retaining groove of the second mounting arm, and a second end engaging the second inner edge so as to bias the second inner edge upward. The second end of the spring plate has a first portion for abutting against a bottom surface of the contact plate and a second portion for abutting against a top surface of the contact plate, thereby preventing release of the second end from the second inner edge.

BRIEF DESCRIPTION OF THE DRAWINGS

Other features and advantages of the present invention will become apparent in the following detailed description of preferred embodiments of the invention, with reference to the accompanying drawings, in which.

DETAILED DESCRIPTION OF THE PREFERRED EMBODIMENTS

Figure 1:
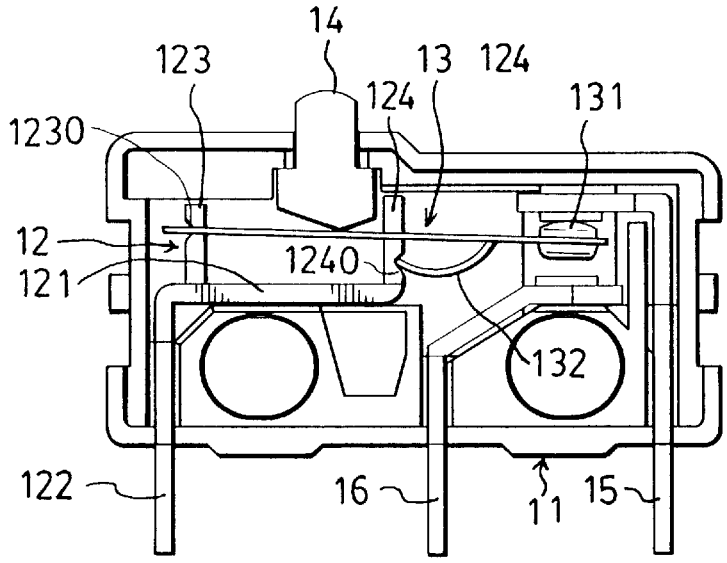
FIG. 1 PRIOR ART
FIG. 1 is a side view of a contact switch with a conventional conducting unit.
Figure 2:
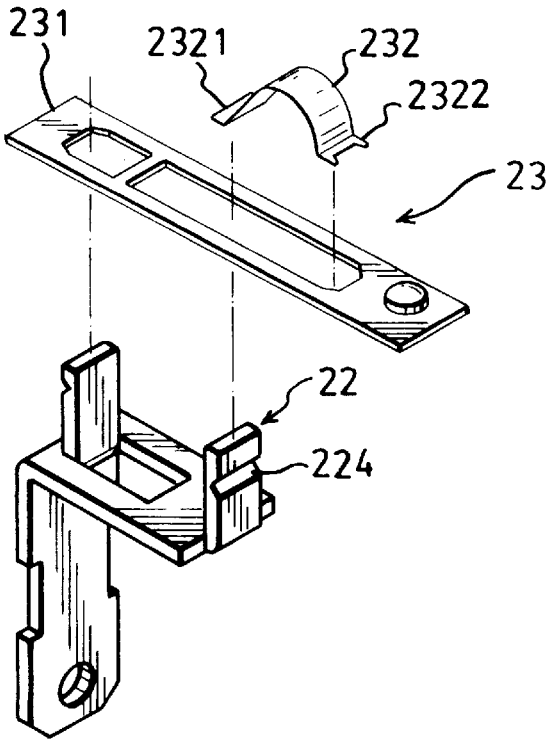
FIG. 2 PRIOR ART
FIG. 2 is an exploded perspective view of another conventional conducting unit.
Figure 3:
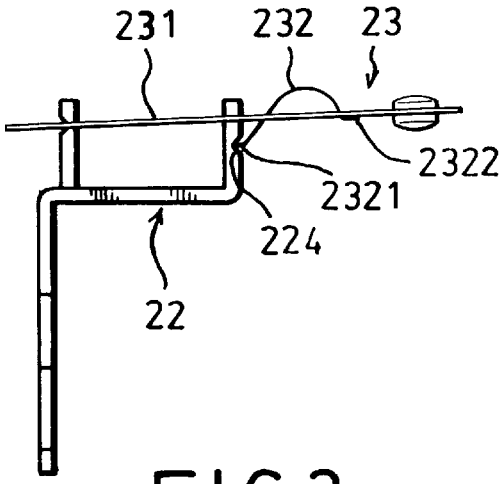
FIG. 3 PRIOR ART
FIG. 3 is a side view of the conducting unit of FIG. 2.
Figure 4:
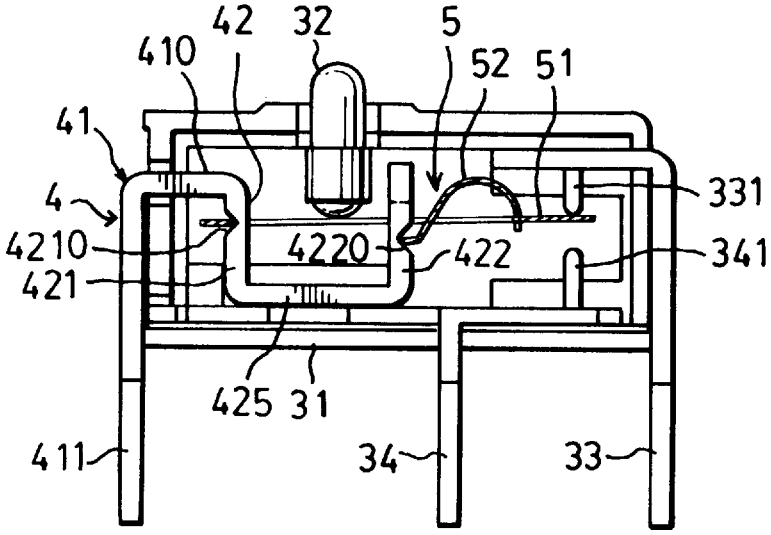
FIG. 4 is a side view of a contact switch of the first preferred embodiment according to the present invention.

Referring to FIG. 4, the first preferred embodiment of a contact switch assembly according to the present invention is shown having a casing 31, a button member 32, second and third conductor bodies 33, 34, a first conductor body 4, and a movable contact arm 5 mounted on the first conductor body 4. Each of the conductor bodies 4, 33, 34 is disposed in the casing 31, and has a leg portion which extends out of the casing 31. The second and third conductor bodies 33, 34 have contact portions 331, 341 disposed respectively above and below the contact arm 5. The button member 32 is disposed in the casing 31 on top of the contact arm 5, and is operable so as to move the contact arm 5 from a first position, where the contact arm 5 connects the first and second conductor bodies 4, 33, to a second position, where the contact arm 5 connects the first and third conductor bodies 4, 34.

The first conductor body 4 includes a U-shaped mounting unit 42 that has upright first and second mounting arms 421, 422 with upper and lower ends, and an elongated horizontal connecting portion 425 which interconnects the lower ends of the first and second mounting arms 421, 422. The first and second mounting arms 421, 422 have retaining grooves 4210, 4220 which extend horizontally at opposing outer sides thereof. The second mounting arm 422 has a top retaining flange 423. The retaining groove 4210 of the first mounting arm 421 is disposed higher than the retaining groove 4220 of the second mounting arm 422 relative to the connecting portion 425. The first conductor body 4 further includes a leg portion 41 with a horizontal section 410 which extends integrally from the upper end of the first mounting arm 421 in a direction away from the second mounting arm 422, and a vertical section 411 which extends integrally and downwardly from the horizontal section 410. The vertical section 411 is parallely spaced from the first mounting arm 421.

Figure 5:
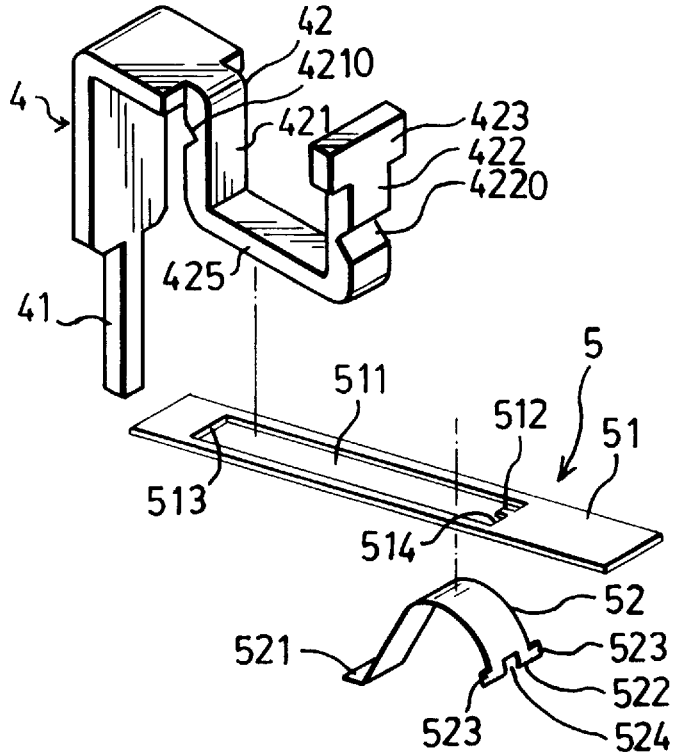
FIG. 5 shows a portion of the first preferred embodiment before assembly.
Figure 6:
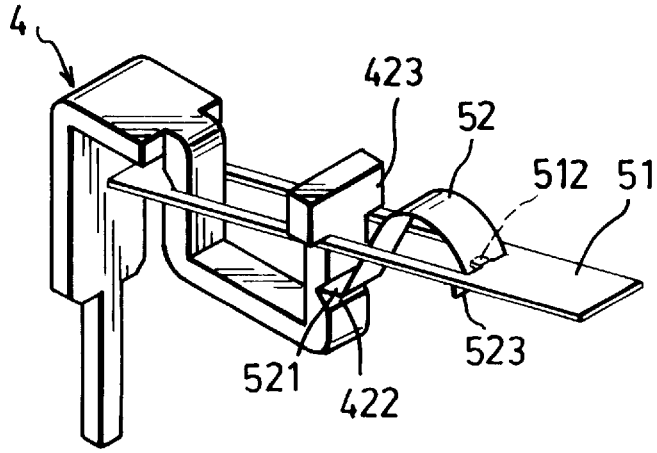
FIG. 6 is a perspective view of the portion shown in FIG. 5 after assembly.

Referring to FIGS. 5 and 6, the contact arm 5 includes an elongated contact plate 51 and a curved spring plate 52. The contact plate 51 has a longitudinal opening 511, a first inner edge 513 and a second inner edge 514 at two longitudinally opposing ends of the opening 511. The second inner edge 514 has a lug 512 extending into the opening 511. In this embodiment, the spring plate 52 is curved upward, and has a first end 521 and a second end 522. The second end 522 has two protrusions 523 at two opposite sides thereof and an intermediate notched part 524.

The contact arm 5 and the first conductor body 4 can be brought together before assembly in the casing 31. In assembly, the contact plate 51 is mounted on the first conductor body 4 by putting the former around the first and second mounting arms 421, 422 of the latter via the opening 511 from the lower end of the latter. The first inner edge 513 of the contact plate 51 is placed into engagement with the retaining groove 4210 of the first mounting arm 421. The intermediate part of the contact plate 51 engages the top retaining flange 423. The spring plate 52 is bent to convex upward and is inserted into the opening 511 in an upward direction. The first end 521 of the spring plate 52 is engaged in the retaining groove 4220 of the second mounting arm 422. The second end 522 of the spring plate 52 extends through the opening 511, and the protrusions 523 protrude downward and abut against a bottom surface of the contact plate 51, thereby biasing upward the contact plate 51. In this situation, the intermediate notched part 524 engages a top surface of the lug 512 to prevent downward release of the second end 522 of the spring plate 52 from the second inner edge 514, whereby firm engagement between the contact plate 51 and the spring plate 52 is thus achieved. In addition, the top retaining flange 423 limits upward movement or upward removal of the contact arm 5 from the first conductor body 4 due to the upward biasing force of the spring plate 52.

Figure 7:
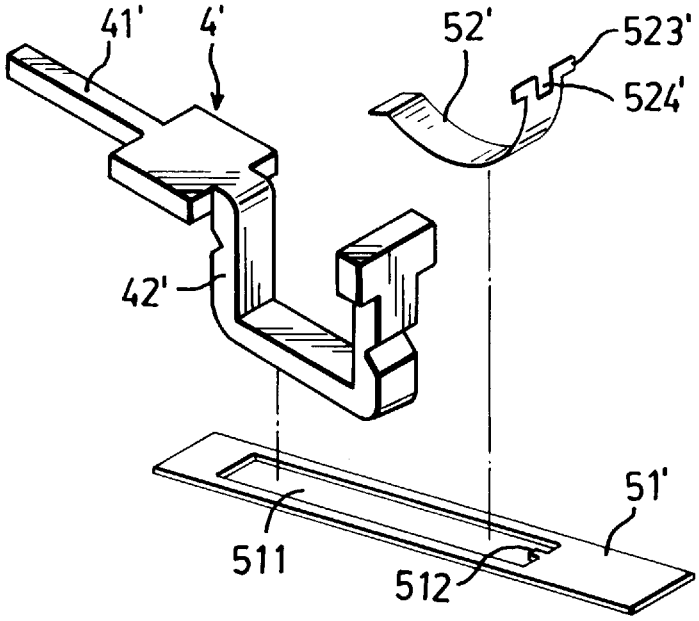
FIG. 7 is a view showing a portion of the second preferred embodiment of the present invention before assembly.
Figure 8:
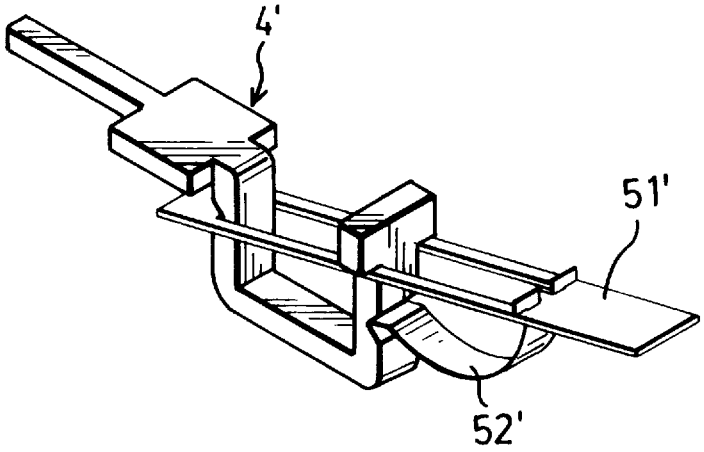
FIG. 8 is a perspective view of the portion shown in FIG. 7 after assembly.

FIGS. 7 and 8 illustrate the second preferred embodiment of the present invention. As shown, the second preferred embodiment is generally similar to the first preferred embodiment except for the leg portion 41' of the first conductor body 4' and the spring plate 52'. In this embodiment, the leg portion 41' extends horizontally from the mounting unit 42' and is not provided with a downwardly extending section. The spring plate 52' is curved or convex downward. After the contact plate 51' is mounted on the first conductor body 4', the spring plate 52' is inserted into the opening 511 from the top of the contact plate 51'. The protrusions 523' abut against the top surface of the contact plate 51' to prevent downward release movement while the intermediate notched part 524' engages the bottom surface of the lug 512 to urge the contact plate 51' upward.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A contact switch assembly, comprising:

a first conductor body including a first leg portion, and a U-shaped mounting unit that has upward first and second mounting arms and a connecting portion which interconnects lower ends of said first and second mounting arms, said first leg portion extending from an upper end of said first mounting arm and said first and second mounting arms having transverse retaining grooves at opposing outer sides thereof;

a movable contact arm including an elongated contact plate which has a longitudinal opening and which is sleeved around said first and second mounting arms via said opening, said contact plate further having first and second inner edges at two longitudinally opposing ends of said opening, said first inner edge engaging said retaining groove of said first mounting arm; and a curved spring plate having a first end which engages said retaining groove of said second mounting arm, and a second end which engages said second inner edge of said contact plate so as to bias said second inner edge upward; said second end of said spring plate having a first portion for abutting against a bottom surface of said contact plate, and a second portion for abutting against a top surface of said contact plate to prevent downward release of said second end of said spring plate from said second inner edge of said contact plate;

said second mounting arm having a top retaining flange that protrudes upward from said opening of said contact plate and that engages said contact plate at a location between said first and second inner edges thereof.

2. The contact switch assembly as claimed in claim 1, wherein said contact plate has a lug extending into said opening from said second inner edge.

3. The contact switch assembly as claimed in claim 2, wherein said spring plate is convex upward, said first portion thereof protruding downward from said opening and abutting against said bottom surface of said contact plate, said second portion thereof being formed as a notch that engages a top surface of said lug.

4. The contact switch assembly as claimed in claim 2, wherein said spring plate is convex downward, said first portion thereof protruding upward from said opening and abutting against said top surface of said contact plate, said second portion thereof being formed as a notch that engages a bottom surface of said lug.

5. The contact switch assembly as claimed in claim 2, further comprising:

a second conductor body having a contact portion which extends above said contact plate adjacent to said second inner edge;

a third conductor body having a contact portion which extends below said contact plate adjacent to said second inner edge; and a casing containing said first, second and third conductor bodies;

said contact plate normally contacting said contact portion of said second conductor body and being capable of contacting said contact portion of said third conductor body when pressed downward.

* * * * *